United States Patent [19]

Duff et al.

[11] 4,344,353

[45] Aug. 17, 1982

[54] HAMMER

[75] Inventors: John Duff; Peter McFarlane, both of North Bay, Canada

[73] Assignee: Joy Manufacturing Company, Pittsburgh, Pa.

[21] Appl. No.: 264,495

[22] Filed: May 18, 1981

Related U.S. Application Data

[63] Continuation of Ser. No. 39,051, May 14, 1979, abandoned.

[51] Int. Cl.[3] ..... F01L 17/00; F01L 25/06

[52] U.S. Cl. ..... 91/165; 91/276; 91/308; 91/319; 92/134

[58] Field of Search ..... 92/134; 91/276, 165, 91/308, 319, 321

[56] References Cited

U.S. PATENT DOCUMENTS

| | | | |
|---|---|---|---|
| Re. 27,244 | 12/1971 | Voitsekhovsky | 60/407 |
| 2,559,478 | 7/1951 | Stone | 173/119 |
| 2,861,486 | 11/1958 | Brauer | 91/457 |
| 3,045,768 | 7/1962 | Huffman | 175/100 |
| 3,060,894 | 10/1962 | Dean, Jr. et al. | 91/276 |
| 3,456,741 | 7/1969 | James | 173/116 |
| 3,460,636 | 8/1969 | James | 173/116 |
| 3,487,752 | 1/1970 | James | 92/85 Z |
| 3,552,269 | 1/1971 | Arndt | 91/321 |
| 3,642,076 | 2/1972 | Coyne et al. | 173/119 |
| 3,739,863 | 6/1973 | Wohlwend | 92/134 |
| 3,800,664 | 4/1974 | Phillips | 91/308 |
| 3,866,690 | 2/1975 | Lance et al. | 91/165 |
| 3,872,934 | 3/1975 | Terada | 173/134 |
| 3,925,985 | 12/1975 | Peterson | 92/134 |
| 4,062,268 | 12/1977 | Hibbard | 91/165 |
| 4,089,252 | 5/1978 | Patel et al. | 91/49 |

*Primary Examiner*—Paul E. Maslousky

*Attorney, Agent, or Firm*—William J. O'Rourke, Jr.

[57] ABSTRACT

A hammer or impactor apparatus including improved motive fluid means cooperable with spring bias means to reciprocably drive a hammer element and an improved process of hammer cycling achieved thereby.

19 Claims, 5 Drawing Figures

HAMMER

This application is a continuation of application Ser. No. 39,051, filed May 14, 1979, now abandoned.

In the impactor art it is known to provide a free piston fluid engine wherein a reciprocable hammer piston repetitively impacts upon a striking bar or anvil to deliver impact energy to a bit which is carried by the striking bar and maintained in forceful engagement with a work object such as a rock formation. The blow energy of each hammer piston impact stroke is thus utilized to fracture or disintegrate the rock formation as desired. Such impactor apparatus has commonly been employed in hard rock mining, quarrying, and earth works construction among other uses.

Among prior impactors have been those in which a fluid or mechanical spring bias means acts continuously upon the rearward or upstroke end of the hammer piston to provide motive force for driving the hammer piston through its power stroke to impact. Such impactors typically rely upon motive fluid pressure applied to the forward end of the hammer piston to upstroke or "cock" the piston against the continuously applied force of the spring bias means thus storing energy in the spring. The motive fluid pressure is then exhausted to release the hammer piston whereupon the energy stored in the spring drives the hammer piston through its power stroke to impact. This upstroking and releasing of the hammer piston is repeated to provide a relatively rapid succession of impact blows to the work object. If the impact blows are generated with sufficient frequency the apparatus may be employed as an impact drilling device.

The present invention contemplates various improvements over such known impactors including, but not limited to, improved hammer piston reciprocation wherein an actuator valve means is operable under the cooperating impetus of motive fluid pressure and the force of a spring bias means to direct motive fluid flow for actuating a motive fluid inlet and exhaust valve means. According to the present invention, operation of the actuator valve means is influenced by the effect of the hammer piston upon the spring bias means as energy is alternately stored in and released from the spring bias means during the repetitive hammer piston upstrokes and impact strokes. Likewise, the motive fluid pressure exerts an influence upon the magnitude of the potential energy stored in the spring bias means through its action upon the actuator valve means. The present invention thus provides for novel modes of cooperation between motive fluid pressure, a spring bias means, hammer piston, actuator valve, and a motive fluid inlet and exhaust valve means in an impactor apparatus, and an improved means of hammer piston cycling in such an apparatus.

Figure 1:
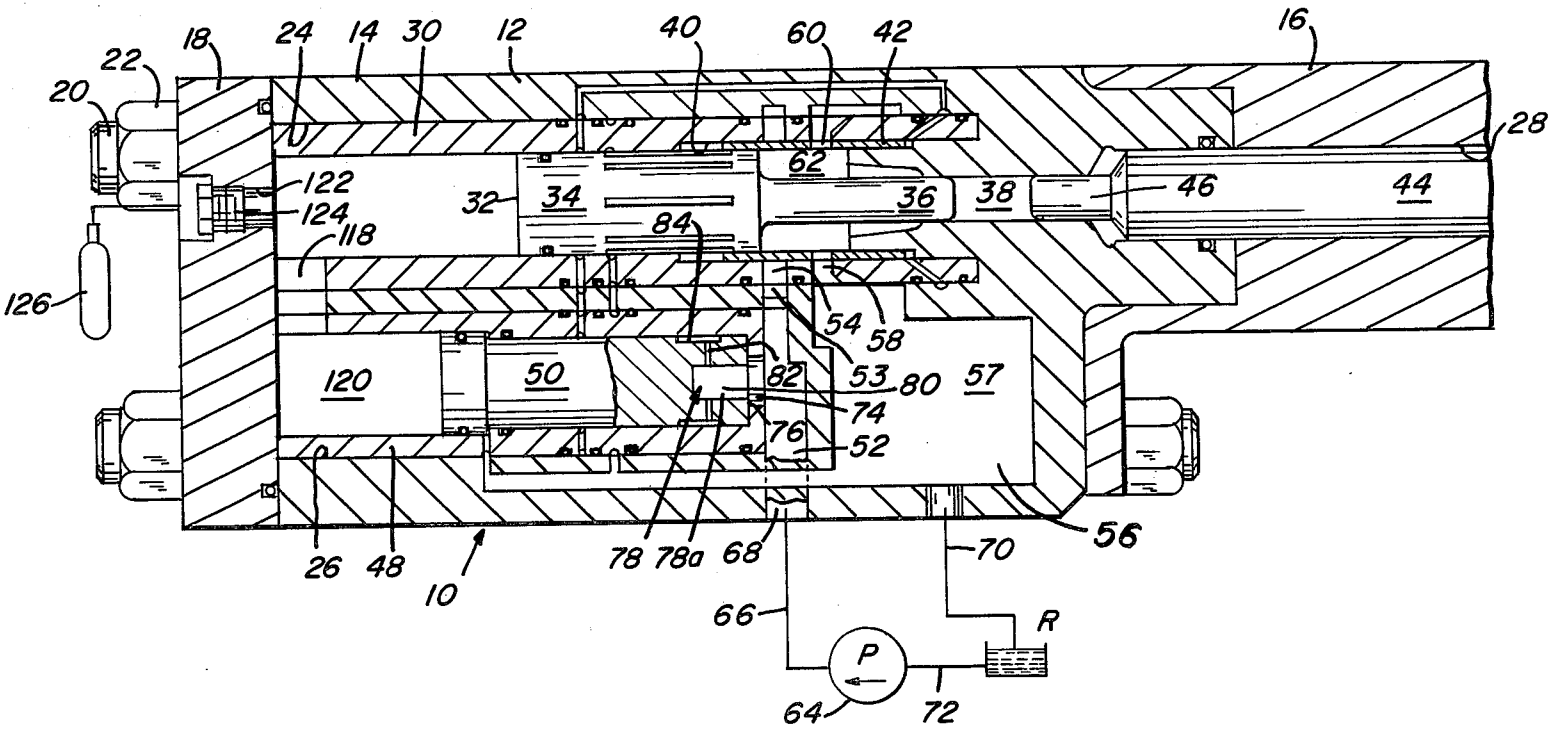

These and other objects and advantages of the invention are more fully specified in the following description with reference to the accompanying drawings, in which:

FIG. 1 is a central longitudinal section of an impactor apparatus constructed according to the principles of the present invention; and FIGS. 2 through 5 inclusive are central longitudinal sections similar to FIG. 1 showing the impactor apparatus at progressive stages of piston reciprocation through a cycle of impactor operation.

There is generally indicated at 10 in FIG. 1 an impactor apparatus constructed according to one preferred embodiment of the instant invention and shown as including a body assembly 12 comprised of a rigid, formed main casing member 14, a machined steel casting for example, disposed axially intermediate a front head 16 and a backhead 18. A plurality of elongated side rods 20 extend longitudinally throughout the length of body assembly 12 and are suitably threaded adjacent their opposite longitudinal ends to receive respective threaded nuts 22 thereon which are tightened down upon front head 16 and backhead 18 to rigidly, releasably secure casing 14 therebetween as shown.

Casing 14 includes a pair of elongated and preferably parallel, generally cylindrical bores 24, 26 extending from the rearward end thereof. Bore 24 is a stepped through bore which is coaxially aligned with a respective through bore 28 formed in front head 16, and bore 26 preferably is a blind bore extending from the rearward end of casing 14. Bores 24, 26 are sealingly closed adjacent their respective rearward ends by backhead 18 as shown.

Bore 24 has disposed therewithin an elongated, generally annular, stepped sleeve or bushing member 30 within which a body portion 34 of a stepped cylindrical hammer piston 32 is axially slideable in such manner that an elongated, forwardly projecting stem portion 36 of hammer 32 may be closely slideably received within an intermediate, reduced diameter portion 38 of bore 24. Bushing 30 also accommodates within an enlarged diameter interior portion 40 thereof a generally annular, elongated sleeve valve member 42 which is slideably disposed for axial movement between motive fluid inlet and exhaust positions as will be described hereinbelow. The forward end portion of bore 24 and the coaxially adjacent portion of bore 28 in front head 16 axially, slideably accommodate therewithin a stepped cylindrical striking bar 44 which includes a rearwardly projecting stem portion 46 that may be slideably received within bore portion 38 such that during impactor operation hammer 32 may be reciprocated for repetitive impact of stem portion 36 upon the striking bar stem 46 either through direct mechanical impact or through transmission of impact forces through a fluid column trapped within the bore portion 38 between the spaced apart end portions of the hammer and the striking bar stems 36, 46.

Within bore 26 is disposed a generally annular, elongated sleeve or bushing 48 having a stepped, cylindrical inner periphery which axially, slideably accommodates therewithin a generally stepped cylindrical piston valve element 50.

Motive fluid flow passage means for fluid actuation of impact apparatus 10 are provided as follows. A fluid inlet passage 52 formed within casing 14 includes an annular passage portion 53 which encompasses bushing 30 to communicate with a fluid inlet port means 54 preferably formed as a plurality of circumferentially spaced ports which radially penetrate bushing 30 to communicate between the inlet passage 52 and valve member 42. Similarly, an exhaust fluid passage 56, formed within casing 14 and preferably including an enlarged exhaust fluid receiving chamber 57, communicates with a plurality of circumferentially spaced fluid exhaust ports 58 which radially penetrate bushing 30 forwardly of inlet ports 54.

Sleeve valve 42 includes a plurality of circumferentially spaced radially extending ports 60 located such that at the extreme rearward and forward axial positions of the valve 42, ports 60 therein cooperably register, respectively, with inlet and exhaust ports 54, 58 to provide selective communication of the space forwardly of piston body 34 (hereinafter designated space 62) with either the fluid inlet or exhaust passages 52, 56. In common practice a suitable hydraulic motive fluid circuit includes a pump which communicates via a suitable fluid flow conduit 66 with inlet passage 52 by way of a port 68 penetrating the outer wall of the casing 14 and including any suitable, conventional connection means (not shown) for connection of conduit 66 thereto. Similarly, exhaust chamber 57 communicates by way of a suitable conduit 70 with a reservoir R which receives exhaust fluid from impactor 10. Pump 64 is maintained in fluid flow communication with reservoir R via a conduit 72 to draw supply fluid therefrom. Of course, it is to be understood that the illustrated hydraulic circuit is greatly simplified for purposes of clarity. The invention does not preclude the use of far more sophisticated known or heretofore unknown motive fluid power systems.

Figure 2:
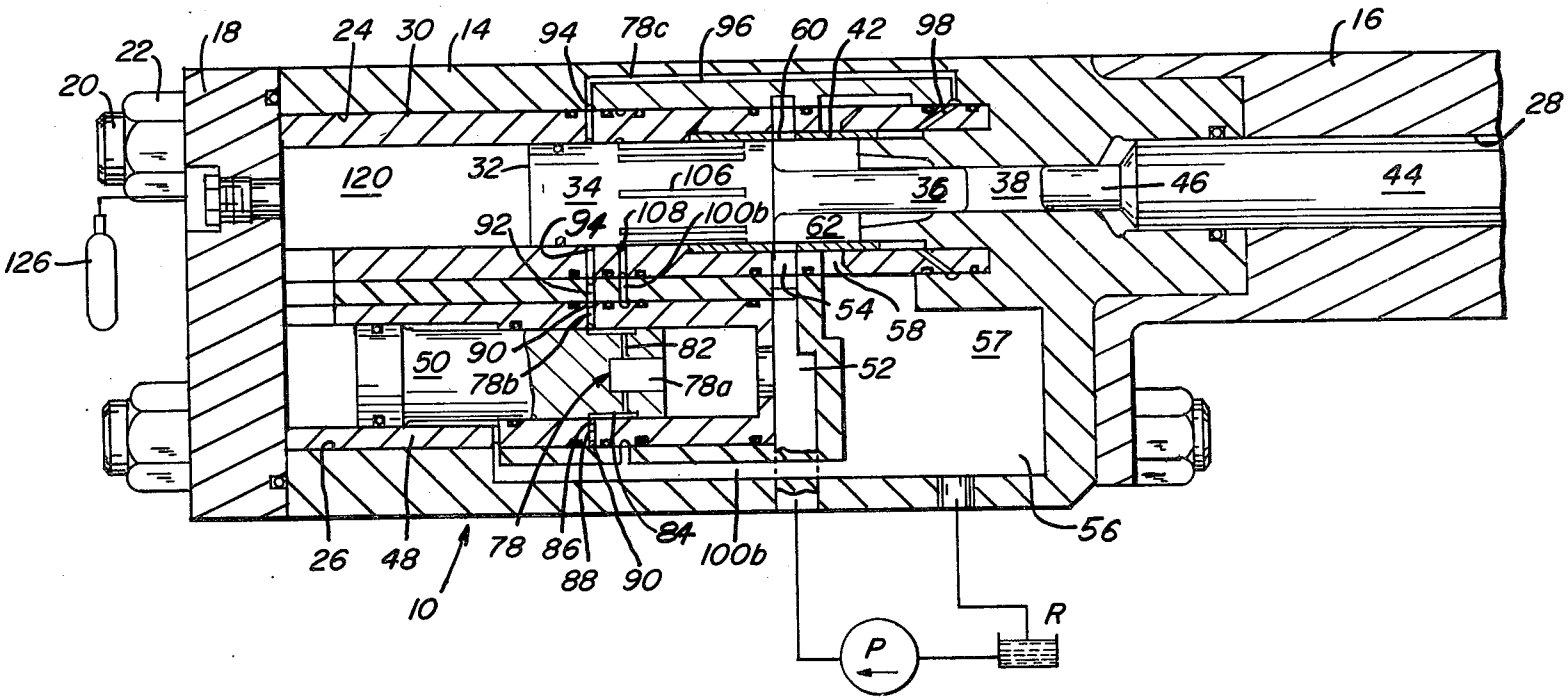

In impactor 10 both hammer 32 and piston valve 50 cooperate with fluid inlet and exhaust passages 52, 56 to provide for flow of actuating motive fluid to the axially opposite ends of sleeve valve 42 for cyclic operation of valve 42 as follows. A through opening 74 penetrates the forwardmost end of bushing 48 whereby motive fluid pressure is continuously supplied from inlet 52 to a forward end surface 76 of piston valve 50. From the piston valve forward end 76 there extends a fluid supply passageway means 78 for delivery of actuating fluid pressure to the forward end of sleeve valve 42 as follows. A first segment **78*a* of passageway means 78 is defined in piston valve 50 by a coaxial blind bore 80 extending from forward end 76 and communicating by way of a plurality of circumferentially spaced and radially extending passages 82 with a respective plurality of circumferentially spaced, longitudinally extending grooves 84 formed in the external periphery of piston valve 50. As shown in FIG. 2, during predetermined portions of the impactor operating cycle when piston valve 50 is displaced from its forwardmost position, grooves 84 communicate with a second passageway segment 78*b* which includes a circumferential groove 86 formed about an inner peripheral portion of bushing 48 and communicating by way of one or more circumferentially spaced passages 88 which radially penetrate bushing 48, with a similar, circumferentially extending peripheral groove 90 formed in the outer periphery of bushing 48. Passageway segment 78*b* further includes at least one passage 92 which communicates with yet another peripheral groove 94 formed in the periphery of bore 24. A final passageway segment 78*c* includes a generally radially and longitudinally extending flow passage 96 communicating adjacent one end thereof with groove 94 and adjacent the opposite end thereof with a plurality of circumferentially spaced ports 98 which radially penetrate a forward end portion of bushing 30 to communicate with the forward end of valve 42 to complete supply passageway 78**.

Figure 3:
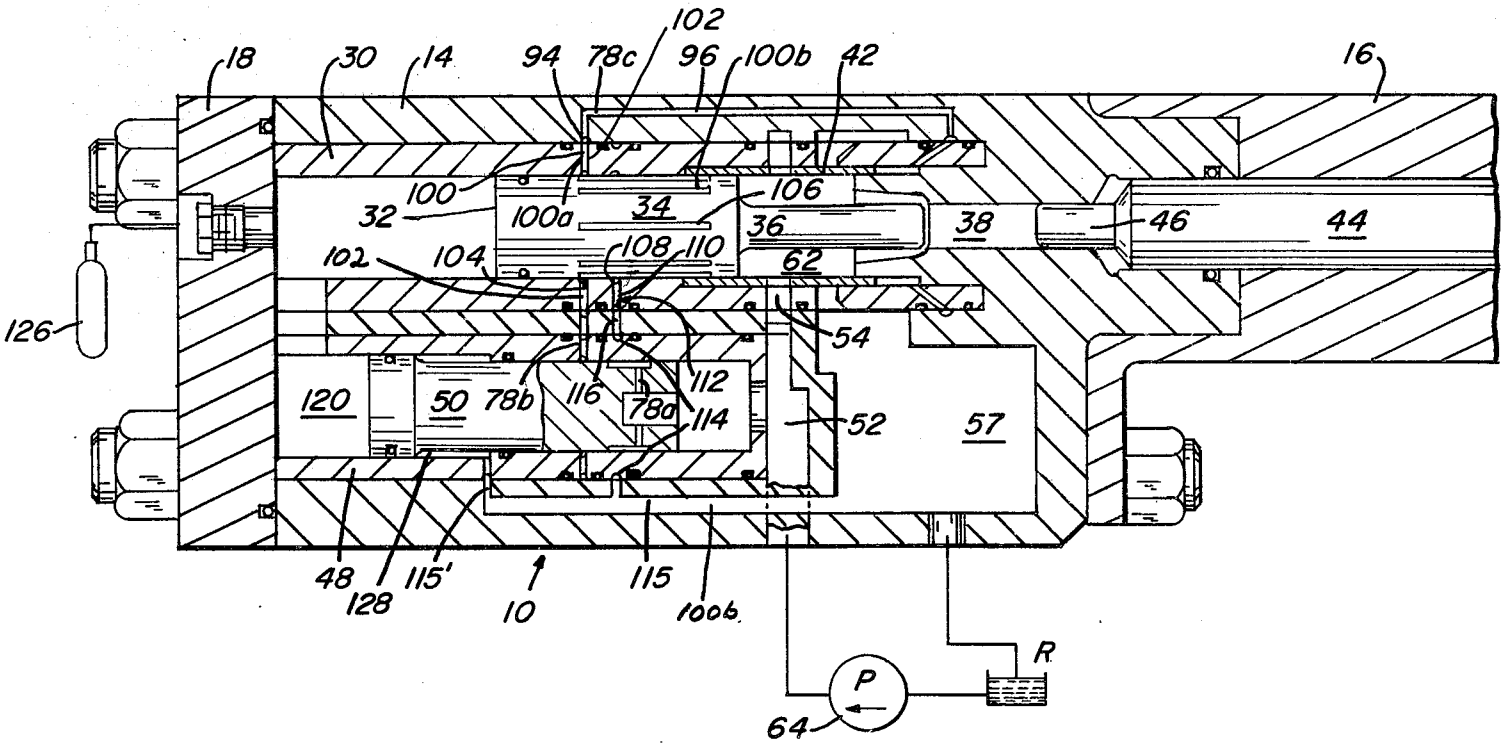

As shown in FIG. 3, during predetermined portions of the impactor operating cycle the passageway segment **78*c* also serves to connect the forward end of valve 42 with exhaust chamber 57 by way of passage 96, groove 94 and an exhaust passageway means 100 including a first passage segment 100*a* comprised of a plurality of circumferentially spaced passages 102 which radially penetrate bushing 30 at such locations therein that during predetermined portions of the impactor operating cylce passages 102 communicate by way of a peripheral groove 104 within the interior of bushing 30 with a second passage segment 100*b* including a plurality of circumferentially spaced and longitudinally extending grooves 106 formed in the periphery of hammer body 34. Grooves 106, in turn, communicate with another peripheral groove 108 and cooperating passages 110 radially penetrating sleeve 30, and passages 110 communicate with a flow network of circumferentially extending peripheral grooves such as indicated at 112, 114 and cooperating passages such as 116 similar in many respects to the construction of the various flow passages described hereinabove. Circumferential groove 114 communicates by way of an elongated passage 115 with chamber 57 to provide for fluid flow thereto from the forward end of valve 42** as will be described hereinbelow.

Figure 4:
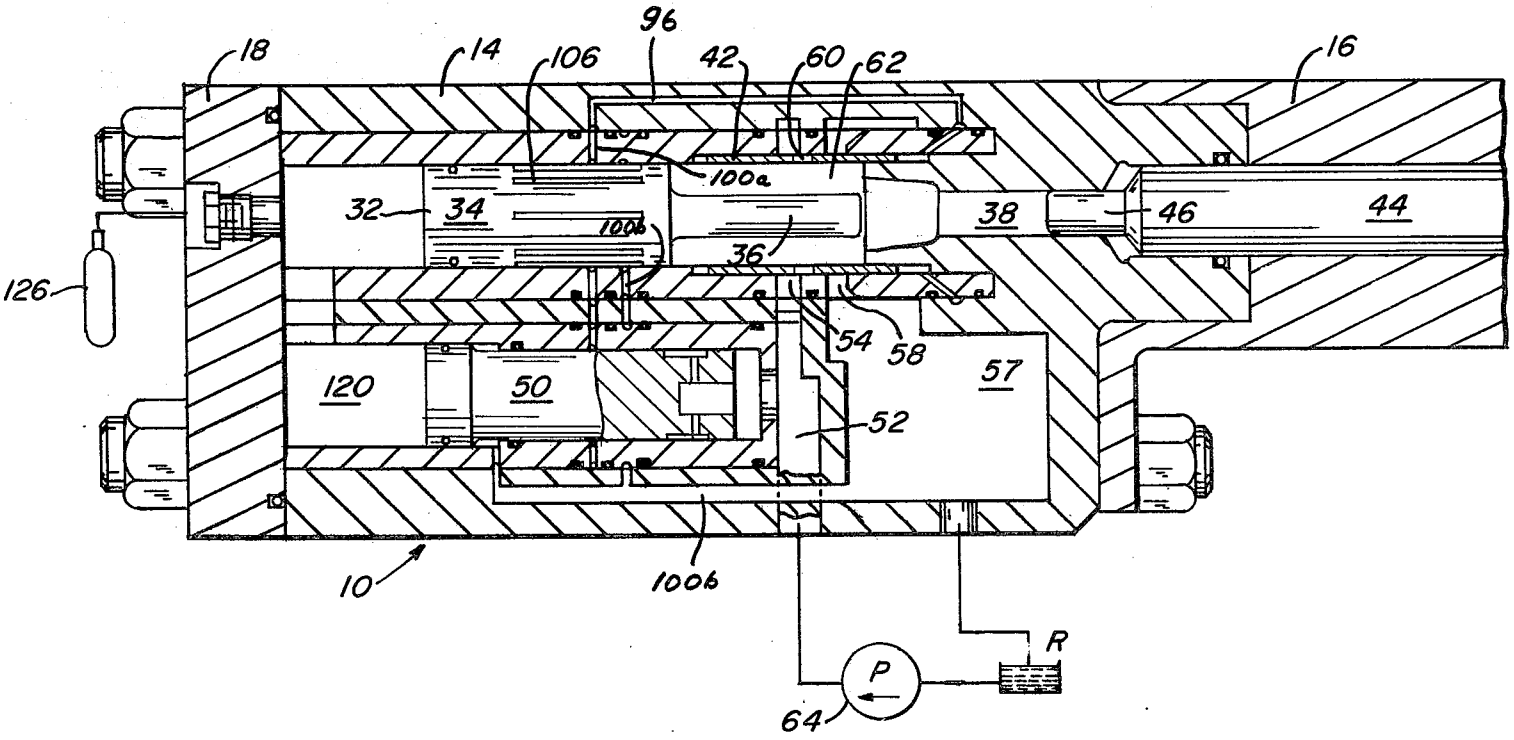

Means are also provided to supply and evacuate motive fluid to and from the rearward end of sleeve valve 42 as follows. As shown in FIG. 2, during predetermined portions of the impactor operating cycle grooves 106 in hammer body 34 provide fluid communication between the rearward end of the valve 42 and groove 108 whereby motive fluid may be exhausted from the rear of valve 42 to chamber 57 by way of exhaust passage segment **100*b* described hereinabove. During other portions of the hammer operating cycle, for example as shown in FIG. 4, the hammer 32 is so positioned that grooves 106 are isolated from the rear of valve 42, and the forward edge of hammer body portion 34 exposes the rear of valve 42 to inlet fluid pressure within space 62** as will be described hereinbelow.

Referring again to FIG. 1, a spring bias means in the form of a fluid pressure accumulator 120 is provided by the interior spaces within each of the bushings 30, 48 intermediate backhead 18 and, respectively, hammer 32 and piston valve 50. These interior spaces are joined for fluid communication by a generally transverse opening 118 communicating therebetween through rearward end portions of bushings 30, 48 and the intervening portion of casing 14. Accumulator 120 is provided with fluid charging and discharging means such as a port 122 which penetrates backhead 18 to communicate between the exterior environment and accumulator 120. As shown, port 122 may include a fluid tight sealed closure such as a plug 124 releasably secured therein to permit charging or release of pressurized gas. Alternatively, plug 124 may be replaced by a fluid conduit connection to connect accumulator 120 to a pressurized gas supply such as a gas bottle 126 as shown schematically. Ideally an accumulator gas precharge, for example approximately 1200 psi (although a substantially greater or lesser precharge may also suffice) is maintained within accumulator 120 during impactor operation.

The impactor structure described hereinabove is operable as follows. Initially in the cycle, with reference to FIG. 1, hammer 32 if at rest in its forwardmost position, having delivered an impact blow to striking bar 44. During the downstroke, exhaust ports 58 were open to chamber 57 whereby fluid in space 62 was directed to the chamber 57. Likewise, ports 54 were closed whereby supply fluid pressure in inlet 52 was cut off from space 62. Piston valve 50 is in its forwardmost position. The continuous application of motive fluid pressure to the forward end 76 of piston valve 50 displaces piston 50 to the left against the bias of the gas precharge contained within accumulator 120 thus compressing the gas and storing additional energy in accumulator 120. Piston valve 50 is progressively displaced to a position (FIG. 2) whereat fluid communication is established between supply passageway segments 78*a* and 78*b* whereby motive fluid pressure is supplied to the forwardmost end of sleeve valve 42 from inlet 52 via passage segments 78*a, b* and *c*. Valve 42 is thus displaced toward its extreme rearward position (to the left as shown) whereat exhaust ports 58 are closed and inlet ports 54 are open to permit motive fluid flow via passage 52 into space 62. To accommodate movement of sleeve valve 42 toward its rearward position, the space rearwardly thereof communicates by way of grooves 106 in hammer body 34 through the remainder of passage segment 100*b* with chamber 57 whereby any fluid behind valve 42 is vented to reservoir R.

Referring now to FIG. 3, the motive fluid pressure supplied by way of the ports 54 into space 62 is effective to retract or upstroke the hammer 32 against the bias of accumulator 120. Inasmuch as the motive fluid supply pressure acting on the hammer 32 will be essentially equal to the accumulator gas pressure during hammer upstroking, essentially equal fluid pressures will be acting upon the opposite ends of piston valve 50. Therefore, a differential area is provided between the opposite longitudinal ends of the piston valve 50, the rearward end thereof being the larger, whereby equal pressures acting on the opposite ends will provide a net force to the right such that the progressive upstroking of the hammer 32 results in concomitant motion of piston valve 50 to the right. As shown the differential area requires a stepped diameter within bushing 48 to accommodate movement of piston valve 50. The variable volume space 128 thus formed is vented to chamber 57 via an extension 115′ of passage 115.

As piston valve 50 moves to the right, the fluid communication between supply passage segments 78*a* and 78*b* is interrupted and fluid supply to the forward end of valve 42 is thus terminated. Thereafter, as the hammer piston upstroke continues, grooves 106 in hammer body 34 register with peripheral grooves 104, 108 (FIG. 3) to provide fluid communication from the forward end of sleeve valve 42 through passage segments 78*c*, 100*a* and 100*b* to chamber 57. As shown in FIG. 3, this occurs prior to the grooves 106 becoming isolated from the rearward end of valve 42. Accordingly, it is necessary in the preferred embodiment that motive fluid supply to the forward end of sleeve valve 42 be terminated before fluid communication therefrom to chamber 57 is established. Otherwise, motive fluid pressure would be supplied to the forward and rearward ends of the sleeve valve 42 simultaneously, and also would be vented directly to chamber 57. It is noted that during the described concomitant movement of hammer 32 and piston valve 50 during hammer upstroking, no additional energy is stored in accumulator 120 inasmuch as the volume thereof is not further reduced. However, at an intermediate point in the hammer upstroke, piston valve 50 may reach its extreme forward position as shown in FIGS. 1 and 5 whereupon further hammer piston upstroking will further compress the gas in accumulator 120 thereby storing additional energy therein.

According to the preferred embodiment, during a major part of the hammer upstroke the forward end portion of hammer body 34 isolates the rearward end of sleeve valve 42 from motive fluid pressure. However, as the hammer piston upstroke progresses the hammer body portion 34 ultimately exposes the rearward end of sleeve valve 42 to the motive fluid pressure within space 62 (FIG. 4) such that sleeve valve 42 begins once again to move to the right inasmuch as the forward end thereof now communicates with exhaust chamber 57 via passages 96, 100*a*, and 100*b*, as described hereinabove. As sleeve valve 42 moves rightward it begins to close inlet ports 54 and subsequently opens exhaust ports 58 as the hammer piston momentum continues the hammer upstroke.

Figure 5:
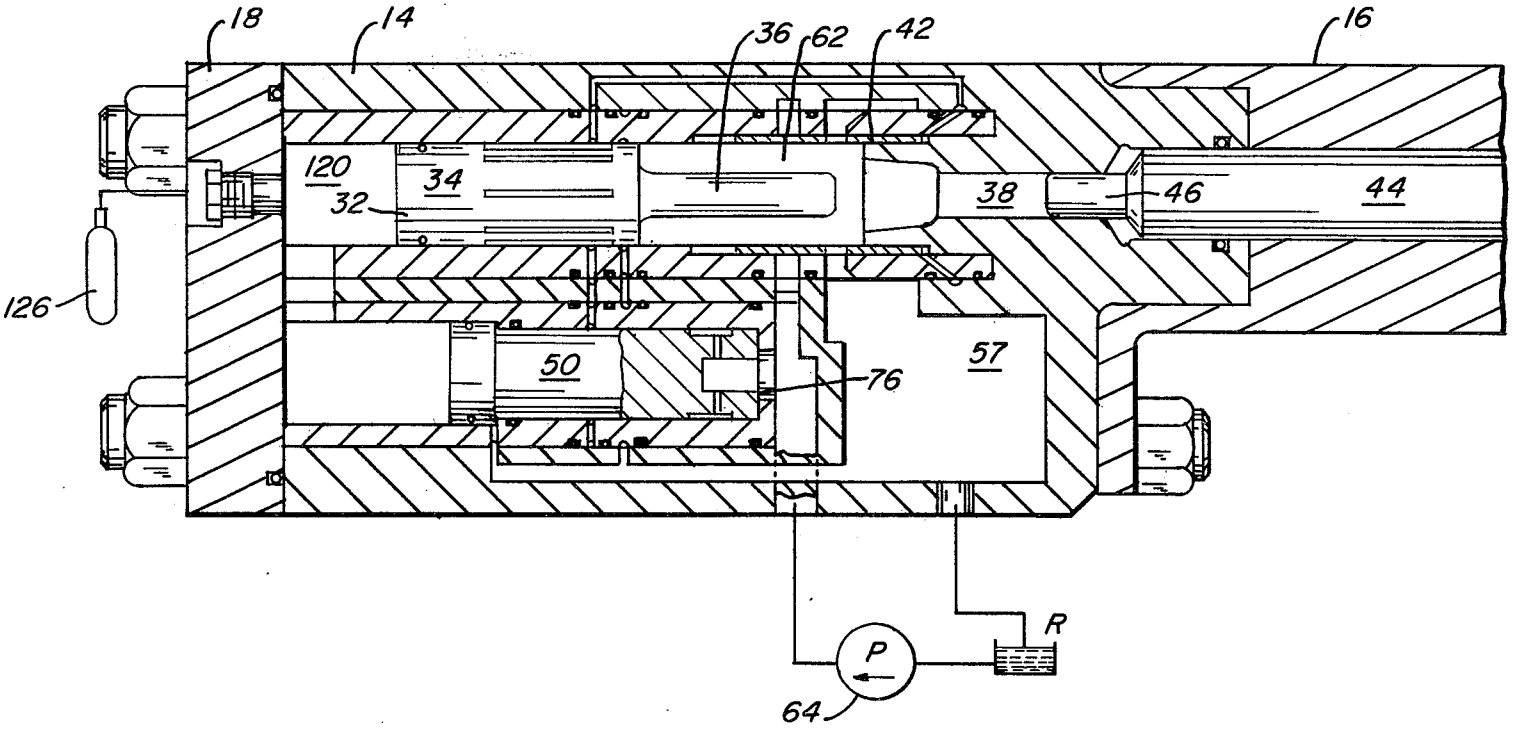

As shown in FIG. 5, sleeve valve 42 ultimately is fully opened to vent fluid pressure within space 62 to chamber 57 and the rearward motion of hammer 32 is terminated. Hammer 32 thus begins its downstroke or impact stroke as it is driven forcefully by the bias of the pressurized gas within accumulator 120 to impact. Simultaneously, the motive fluid pressure applied continuously to the forward end 76 of piston valve 50 begins to move piston valve 50 to the left once again against the gas pressure in accumulator 120 to repeat the impactor operating cycle.

In the impactor described hereinabove the hammer piston upstroke portion of the cycle may take up to 80% or more of the cycle time, and the impact blow rate may therefore be readily increased by increasing the pump flow rate to reduce the duration of the relatively long upstroke cycle portion. The result is greater impact rate (blows per minute) at a constant blow energy. Blow energy may be altered independently of any change in the impact blow rate by increasing or decreasing the gas precharge in accumulator 120. Of course, this may also necessitate an increase in the maximum available motive fluid supply pressure. One feature of the described impactor embodiment is that hammer 32 and piston valve 50 move in opposite directions during the hammer piston downstroke. Piston valve 50 thus tends to counteract some of the reaction forces of the hammer movement which would otherwise be absorbed by the operator or the impactor mountings.

According to the description hereinabove there is provided by the instant invention a novel impactor structure and operating cycle whereby novel modes of cooperation between a spring bias means, hammer piston, actuator valve and a motive fluid inlet/exhaust valve means provide improved impactor operation. It is to be appreciated that the described preferred embodiment is far more narrow and limiting than the intended scope of the invention inasmuch as specific structural details as herein described are considered subordinate to the invention broadly viewed. For example, the various networks of fluid inlet and exhaust passageway means for providing motive fluid flow to the opposite ends of sleeve valve 42 (e.g. passage segments 78*a, b, c* and 100*a, b*) may be modified and varied within a wide design latitude of functional equivalents; hammer 32 and piston valve 50 may be arranged in coaxial alignment with the accumulator 120 and other suitable spring bias means may be disposed therebetween; the spring bias means need not necessarily be a linear spring means; and the like. These and other embodiments and modifications having been envisioned and anticipated by the inventors, the invention should be interpreted as broadly as permitted by the scope of the claims appended hereto.

What is claimed is:

1. In a fluid operable impactor assembly including a reciprocably movable hammer, an independent bias means which continuously exerts on said movable hammer a bias of a magnitude determined solely by the position of said movable hammer in its reciprocal movement and a motive fluid flow control valve means cooperable with a pressure fluid flow source for selectively supplying motive fluid flow to act on said hammer wherein said hammer is responsive to the pressure impetus of the selectively supplied motive fluid flow to move in an upstroke direction against the bias of said bias means and subsequently is responsive to the impetus of said bias means to move in an impact stroke direction opposite said upstroke direction and wherein said control valve means includes a main valve which is actuatable to selectively admit motive fluid flow to said hammer for such upstroke and to vent motive fluid from said hammer to permit said continuous bias means to drive said hammer in said impact stroke direction, the improvement comprising: actuator valve means operable to actuate said main valve in conjunction with the reciprocal movement of said hammer wherein said actuator valve means is operable solely in response to the pressure of such motive fluid from such fluid flow source and the independent, continuous bias of said bias means.

2. The improvement as claimed in claim 1 wherein said main valve includes a fluid operable valve element.

3. The improvement as claimed in claim 2 wherein said actuator valve means controls operation of said main valve by selectively supplying valve operating fluid to said valve element.

4. The improvement as claimed in claim 3 wherein said actuator valve means communicates continuously in biased engagement with said bias means.

5. The improvement as claimed in claim 4 wherein said bias means is cooperable with said hammer and said actuator valve means to provide an operative connection therebetween whereby the upstroke and impact stroke movement of said hammer influences operation of said actuator valve means.

6. The improvement as claimed in claim 5 wherein said operative connection includes compressible means maintained in biased communication with said hammer and said actuator valve means.

7. The improvement as claimed in claim 6 wherein upstroke movement of said hammer influences operation of said actuator valve means such that said compressible means exerts a bias on said actuator valve means which is effective to displace said actuator valve means against the pressure of said motive fluid from such fluid flow source during a portion of such upstroke movement of said hammer.

8. The improvement as claimed in claim 7 wherein said actuator valve means is responsive to the pressure of such motive fluid from such fluid flow source and cooperable with said hammer to compress said compressible means during a portion of such upstroke movement prior to the first mentioned said portion thereof.

9. The improvement as claimed in claim 8 wherein said compressible means includes a compressible gas spring means.

10. The improvement as claimed in claim 1 wherein said hammer includes motive fluid valving portions operable in conjunction with the upstroke and impact stroke motion of hammer to permit said cooperation of said actuator valve means with said hammer to control actuation of said main valve.

11. An impactor assembly comprising: a body member; an elongated bore formed within said body member; a hammer piston reciprocably carried within said bore for movement through alternate upstrokes and work strokes; passageway means for directing motive fluid flow from a motive fluid flow source to said hammer piston; valve means operable to selectively direct motive fluid flow within said passageway means to one end portion of said hammer piston for driving said hammer piston through such an upstroke; a bias means which continuously exerts on the end portion of said hammer piston opposite said one end portion thereof, from an independent source, a bias of a magnitude determined solely by the position of said hammer piston in its reciprocal movement for driving said hammer piston through such a work stroke subsequent to each such upstroke; said valve means including a main valve element carried by said body member and selectively operable to supply motive fluid flow to act on said one end portion of said hammer piston and for venting motive fluid pressure from said one end portion of said hammer piston and an actuator element selectively movable into and out of a fluid supply position whereby actuating fluid flow from said motive fluid flow source is selectively supplied to said main valve element for operation thereof; said actuator element having the pressure of motive fluid from said motive fluid flow source and the independent, continuous bias of said bias means applied thereto in a manner that the motive fluid pressure applied thereto urges said actuator element toward said supply position and the independent, continuous bias of said bias means opposes the impetus of said motive fluid pressure applied thereto whereby the movement of said actuator element alternately to and from said supply position is controlled solely by application thereto of said motive fluid pressure and the independent, continuous bias of said bias means.

12. An impactor assembly as claimed in claim 11 wherein said bias means provides an operative connection between said hammer piston and such actuator element.

13. An impactor assembly as claimed in claim 12 wherein said bias means comprises a compressible spring means.

14. An impactor assembly as claimed in claim 13 wherein said compressible spring means is a gas spring.

15. An impactor assembly as claimed in claim 14 wherein said gas spring is a closed gas system.

16. An impactor assembly as claimed in claim 15 wherein said gas spring exerts a bias simultaneously and continuously on said hammer piston and said actuator element.

17. An impactor assembly as claimed in claim 10 wherein the bias exerted on said hammer piston and said actuator element increases throughout movement of said hammer piston through such upstrokes.

18. A fluid operable impactor assembly comprising: a body member; a hammer piston reciprocably carried within said body member for alternate upstrokes and work strokes; passageway means for directing motive fluid flow from a motive fluid flow source to said hammer piston; valve means operable to selectively supply such motive fluid flow to said hammer piston for moving said hammer piston through such upstrokes; an independent bias means which continuously exerts on said hammer piston a bias of a magnitude determined solely by the position of said hammer piston in its reciprocal movement for driving said hammer piston through such a work stroke subsequent to each such upstroke; said valve means including an actuatable portion selectively movable to a motive fluid supply position wherein motive fluid pressure drives said hammer piston through such an upstroke against the bias of said bias means and a motive fluid exhaust position to permit said bias means to drive said hammer piston through such a work stroke; said valve means including a movable actuator element cooperable with such motive fluid flow source and said bias means to selectively move said actuatable portion to said motive fluid supply and said motive fluid exhaust positions; and said actuator element being operable in response to the pressure of motive fluid from such motive fluid flow source to admit actuating fluid flow to said actuatable portion to move said actuatable portion to said fluid supply position and being operable in response to the independent continuous bias of said bias means as said hammer piston is driven through such upstroke to terminate said actuating fluid flow to said actuatable portion.

19. An impactor assembly as claimed in claim 18 wherein said bias means includes a gas spring.

* * * * *